United States Patent [19]

Robbins et al.

[11] 3,998,282

[45] Dec. 21, 1976

[54] EARTH BORING AUGER

[75] Inventors: Leonard J. Robbins, Pottsboro; Lloyd D. Stewart, Dennison, both of Tex.

[73] Assignee: Reed Tool Company, Houston, Tex.

[22] Filed: Dec. 15, 1975

[21] Appl. No.: 641,041

[52] U.S. Cl. ..... 175/335; 175/351; 175/394

[51] Int. Cl.[2] ..... E21B 9/24

[58] Field of Search ..... 175/394, 335, 336, 351, 175/352

[56] References Cited

UNITED STATES PATENTS

| | | | |
|---|---|---|---|
| 850,533 | 4/1907 | Litaker | 175/335 |
| 893,950 | 7/1908 | Thomas | 175/394 X |
| 1,136,203 | 4/1915 | Bardeen | 175/ 336 X |
| 1,640,644 | 8/1927 | Bullum | 175/394 X |
| 1,719,546 | 7/1929 | Hallett | 175/394 X |
| 2,380,112 | 7/1945 | Kinnear | 175/336 |
| 2,823,025 | 2/1958 | Biedess | 175/335 X |
| 3,094,179 | 6/1963 | Lines | 175/394 |
| 3,905,432 | 9/1975 | Mullins | 175/394 X |

*Primary Examiner*—James A. Leppink
*Assistant Examiner*—Richard E. Favreau
*Attorney, Agent, or Firm*—Neal J. Mosely

[57] ABSTRACT

An earth boring auger having a shaft and helical flights thereon and a plurality of disc cutters mounted below the flights and behind the leading edge thereof to engage the formation before it is engaged by the flights.

5 Claims, 7 Drawing Figures

EARTH BORING AUGER

BACKGROUND OF THE INVENTION

Earth boring augers generally include a shaft with a bit on one end and helical flighting surrounding the shaft. The bit is adapted to engage the formation and drill a hole the size of the shaft. The flighting engages the formation at an acute angle and scrapes the material therefrom and feeds it away from the formation face being engaged. With such structure, these earth boring augers have generally been limited to boring relatively soft formations. Further, the available torque for such earth boring augers is the limiting factor in its rate of penetration.

SUMMARY

The present invention relates to an improved earth boring auger especially adapted for cutting both soft and hard formations, having one or more disc cutters supported on the auger and in position to engage the formation before engagement by the auger flighting.

An object of the present invention is to provide an improved earth boring auger having higher penetration to torque ratios.

Another object of the present invention is to provide an improved earth boring auger capable of boring in harder formations than previous augers.

A further object is to provide an improved earth boring auger capable of cutting kerfs in the formation before engagement by the auger flighting.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
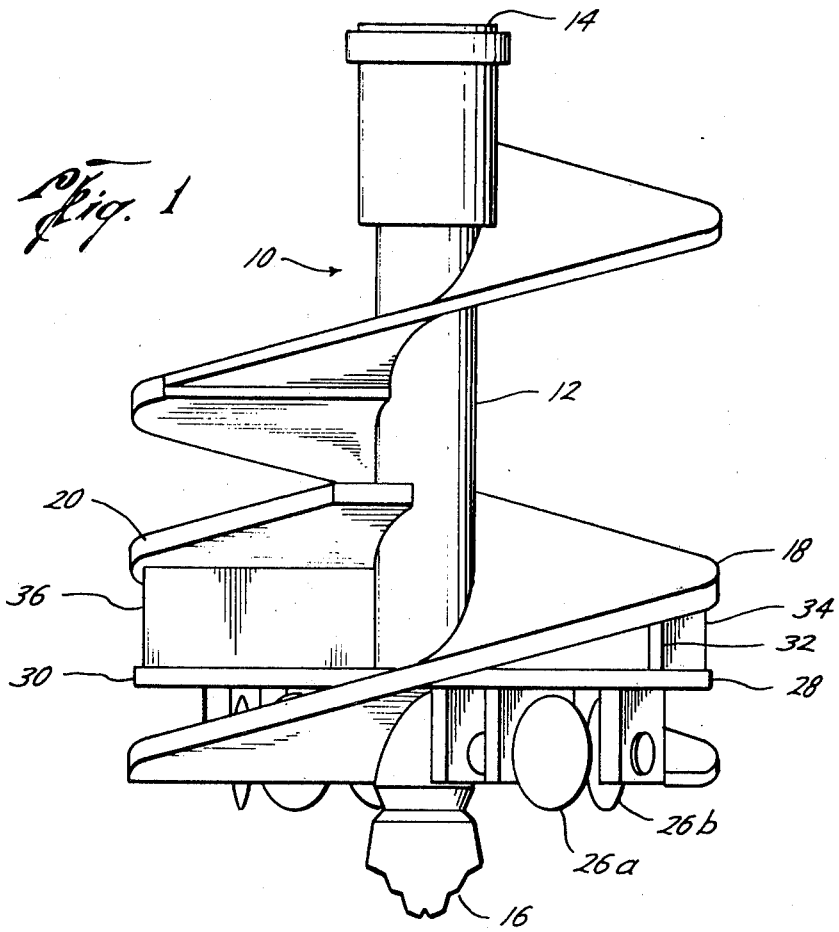
FIG. 1 is a side view of one form of auger embodying the present invention.
Figure 2:
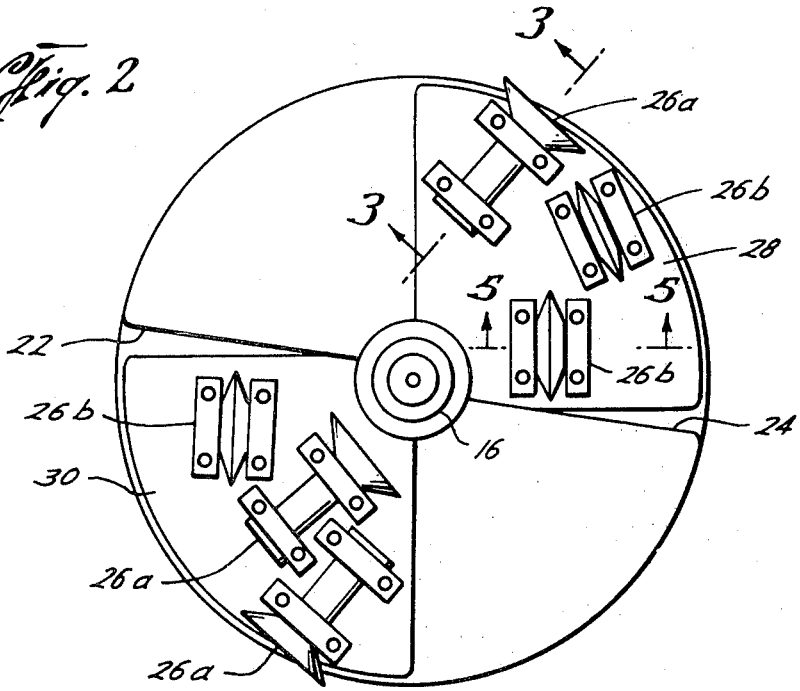
FIG. 2 is a bottom view of the auger shown in FIG. 1.

The auger 10 shown in FIGS. 1 and 2 includes a shaft 12 having means 14 for connecting to a drill string or power source (not shown) at one end and a spade bit 16 at the other end together with primary and secondary helical flightings 18 and 20 secured to and surrounding the shaft with the secondary flighting 20 at the spade bit end of the shaft spaced opposite the primary flighting 18 and extending upwardly thereon only a short distance as shown. The leading edge 22 of the primary flighting 18 is 180° opposite from the leading edge 24 of secondary flighting 20.

As can best be seen in FIG. 2, a plurality of cutter assemblies 26 are shown positioned below flightings 18 and 20. Plates 28 and 30 are suitably secured as by welding below the flightings 18 and 20 and are supported by brackets 32, 34 and 36. As can be seen from FIG. 1, the cutter assemblies 26 are so mounted that they engage the formation to be bored before the leading edges 22 and 24 of flightings 18 and 20.

Each of the cutter assemblies 26 includes a shaft 38, a disc cutter 40, means 42 for rotatively mounting the disc cutter 40, and means 44 for supporting the cutter assembly 26 below the flightings 18 and 20.

The cutter assembly **26*a* is designed to either cut a gage kerf or the innermost kerf. As shown in FIG. 2, there are three of the cutter assemblies 26*a* and three of the cutter assemblies 26*b*.**

Figure 3:
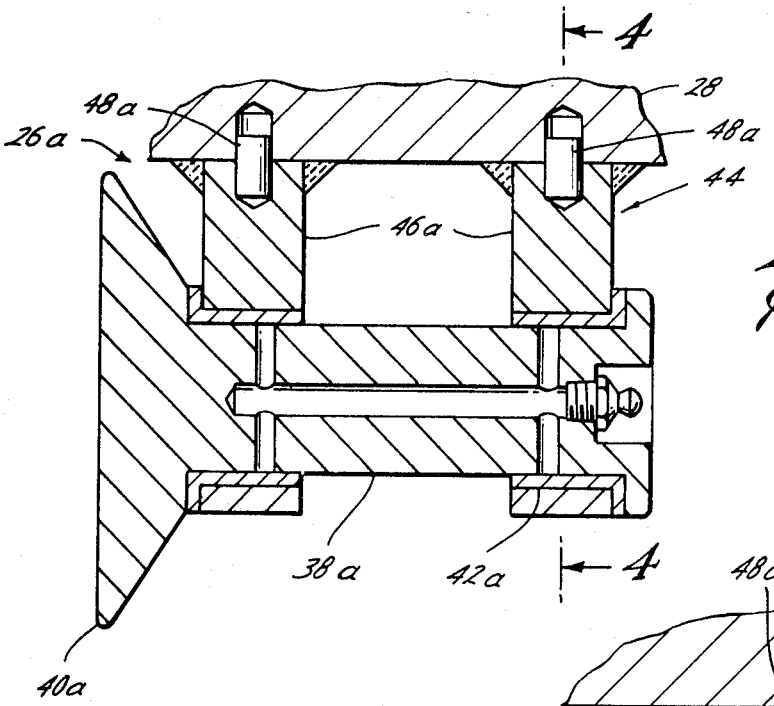
FIG. 3 is a sectional view taken along line 3—3 in FIG. 2.
Figure 5:
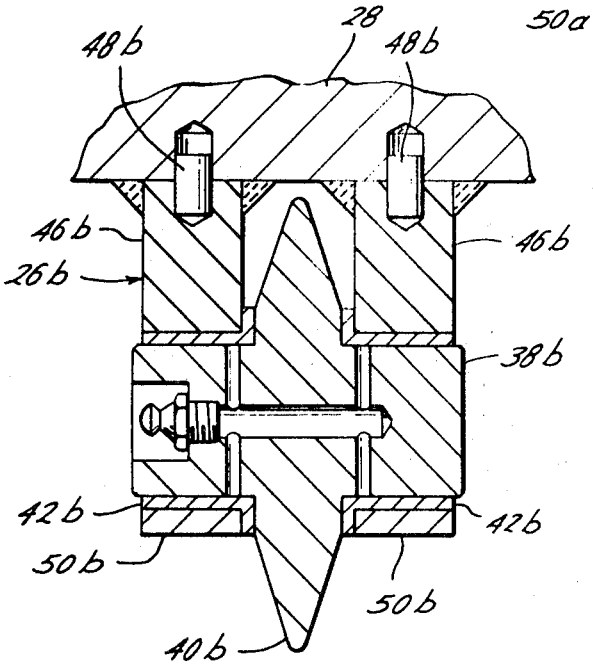
FIG. 5 is a typical sectional view of the cutter supports and bearings.

The details of structure of the cutter assembly **26*a* are shown in FIG. 3 and include shaft 38*a*, disc cutter 40*a* and the bearing means such as bushings 42*a*. The saddles 46*a* are keyed into position on plates 28 and 30 by the pins 48*a* as shown. The saddles 46*a* are welded in position and the caps 50*a* are secured to the saddles 46*a* by cap screws 52*a* with the shaft 38*a* and bushings 42*a* positioned therein to support disc cutter 40*a* which is integral on the end of a shaft 38*a* as shown in FIG. 5. The support means 44 includes the saddles 46*a* and the caps 50*a*.**

Figure 4:
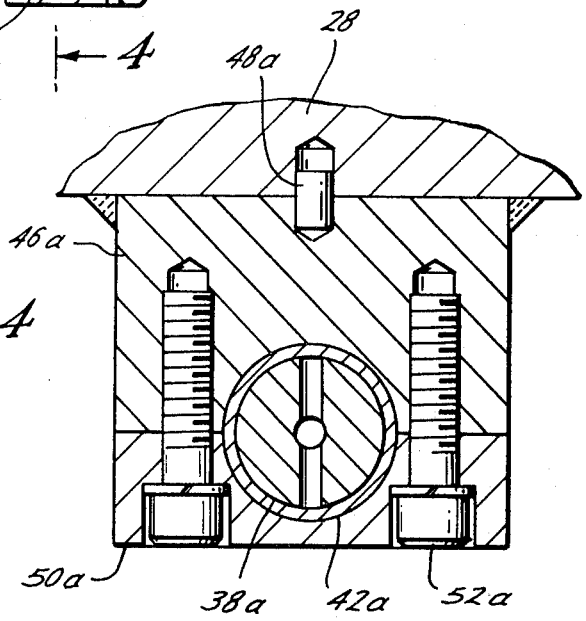
FIG. 4 is a sectional view taken along line 4—4 in FIG. 2.

The cutter assembly **26*b* as shown in FIG. 4 includes shaft 38*b*, disc cutter 40*b* and the bearing means such as bushings 42*b*. The saddles 46*b* are keyed into position on plates 28 and 30 by the pins 48*b* as shown. The saddles 46*b* are welded in position and the caps 50*b* are secured to the saddles 46*b* by cap screws (not shown) with the shaft 38*b* and bearings 42*b* positioned therein to support disc cutter 40*b* between the saddles 46*b*.**

While the disc cutters **40*a* and 40*b* are both shown to be integral with the shafts 38*a* and 38*b*,** the cutters may be separately mounted on the shafts with suitable bearings.

As can be seen from FIG. 2, each of said disc cutters 40 has a different radial position with respect to the shaft 38 so that their respective kerfs will each have a different radius. This allows a substantial portion of the face of the formation to be cut in kerfs before it is engaged by the flightings to thereby greatly reduce the torque necessary to rotate the auger.

Figure 6:
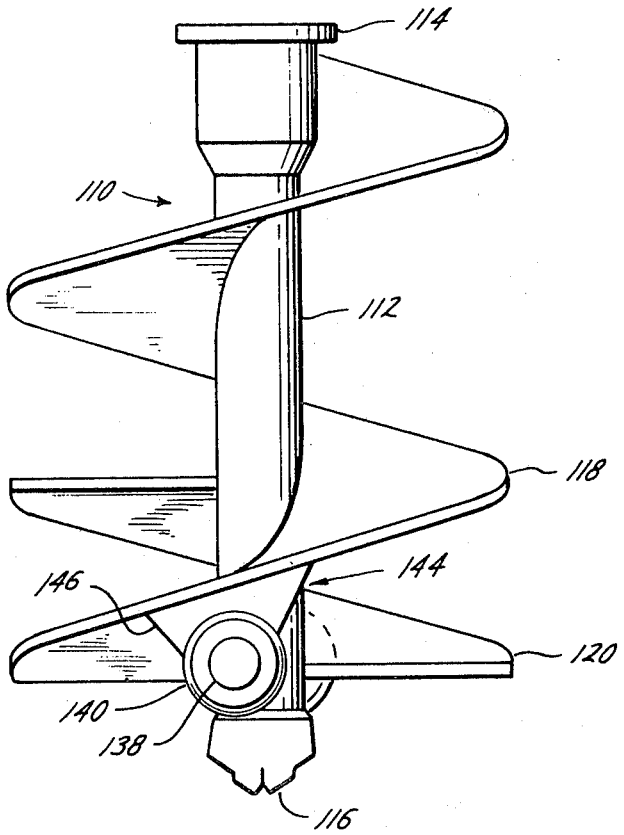
FIG. 6 is a side view of another form of the auger embodying the present invention.
Figure 7:
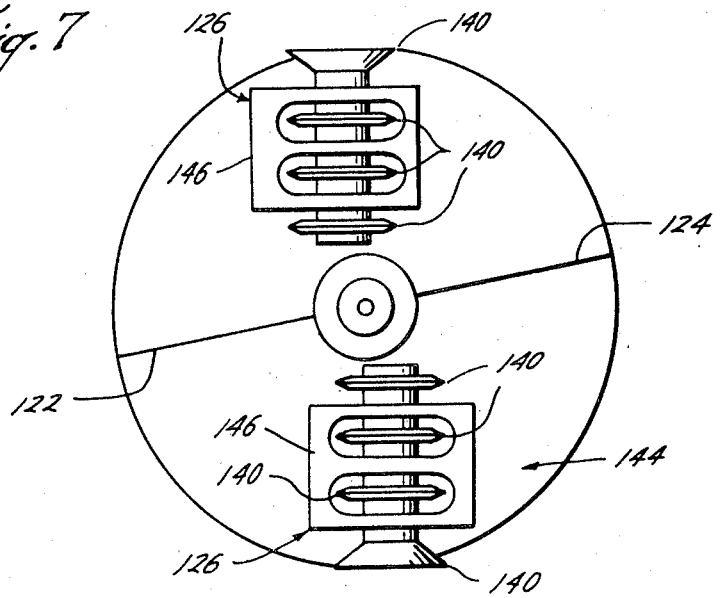
FIG. 7 is a bottom view of the auger shown in FIG. 6.

The earth boring auger 110 shown in FIGS. 6 and 7 is similar to auger 10 in that it includes a shaft 112 having means 114 for connecting to a drill string or power source at one end and a spade bit 116 at the other end together with primary and secondary helical flightings 118 and 120 secured to and surrounding shaft 112 with the secondary flighting 120 at the spade bit end of the shaft 112 spaced opposite the primary flighting 118 and extending upwardly thereon only a short distance. The leading edge 122 of the primary flighting 118 is 180° opposite from the leading edge 124 of secondary flighting 120.

The cutter assemblies 126, however, differ and each include a shaft 138, disc cutters 140, means 144 for supporting the cutter assembly 126 in position below the flightings 118 and 120 as shown. Such support means 144 includes a saddle 146 secured to the underside of its flighting. Each saddle 146 supports a plurality of disc cutters 140 including cutters mounted on the ends and central portions of shaft 138. Suitable bearing means (not shown) are provided for each cutter 140.

The cutter assemblies 126 are positioned under the flightings 118 and 120 at a position behind the leading edges 122 and 124. The axis of each of the cutter assemblies 126 is positioned to fall slightly ahead of the axis of the shaft 112. Also, such axis forms an angle of approximately 100° with its respective leading edge.

From the foregoing it can be seen that the present invention does provide an improved earth boring auger capable of boring much harder formations than could be penetrated with prior augers and having a relatively high ratio of penetration to torque. Such improved auger provides these advantages by having structure to cut one or more kerfs in the formation before engagement of the formation by the auger flighting.

The improved auger of the present invention has the advantages hereinbefore set forth and further may be used in any type of boring whether vertical or horizontal. The improved auger functions in the same improved manner in all positions.

We claim:

1. An earth boring auger, comprising
a shaft having means for connecting to a power source on one end thereof,
a flighting helically surrounding and secured to said shaft,
said flighting having a leading edge near the end of said shaft opposite said connecting means,
at least one cutter assembly including
a disc cutter and means for rotatively mounting said disc cutter for rolling cutting motion, and
means supporting said cutter assembly from said flighting near the drilling end of and spaced radially from said shaft a substantial distance behind the leading edge of said flighting and extending longitudinally beyond said flighting whereby said cutter engages the formation to be bored with a rolling cutting motion to cut a kerf therein prior to engagement of said flighting with said formation.

2. An earth boring auger according to claim 1, including
a second flighting helically surrounding and secured to said shaft and being 180° opposite the other flighting with respect to said shaft,
a second cutter assembly including
a second disc cutter and means for rotatively mounting said second disc cutter, and
means supporting said second cutter assembly from said second flighting near the drilling end of shaft a substantial distance behind the leading edge of said second flighting whereby said second cutter engages the formation to be bored to cut a second kerf therein prior to engagement of said flightings with said formation.

3. An earth boring auger according to claim 2, including
a plurality of cutter assemblies positioned underneath each of said flightings.

4. An earth boring auger according to claim 3, wherein
each of said cutter assemblies has a different effective radial position with respect to said shaft.

5. An earth boring auger according to claim 1, wherein
the axis of rotation of said disc cutter does not pass through the axis of shaft.

* * * * *